US008487732B2

(12) United States Patent
Takeuchi et al.

(10) Patent No.: US 8,487,732 B2
(45) Date of Patent: Jul. 16, 2013

(54) COIL TRANSFORMER COMPOSED OF UNIT CONFIGURATION

(75) Inventors: Masaki Takeuchi, Tainai (JP); Atsushi Suzuki, Tainai (JP); Tatsuhito Azegami, Shibata (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 0 days.

(21) Appl. No.: 13/021,232

(22) Filed: Feb. 4, 2011

(65) Prior Publication Data

US 2011/0234355 A1 Sep. 29, 2011

(30) Foreign Application Priority Data

Mar. 26, 2010 (JP) ..... 2010-072455

(51) Int. Cl.

| | |
|---|---|
| ***H01F 21/12*** | (2006.01) |
| ***H01F 27/28*** | (2006.01) |
| ***H01F 21/04*** | (2006.01) |
| ***H01F 21/02*** | (2006.01) |
| ***H01F 27/30*** | (2006.01) |

(52) U.S. Cl.

USPC ..... 336/150; 336/170; 336/126; 336/147; 336/205

(58) Field of Classification Search

USPC ..... 336/192, 147, 150, 146, 180, 107, 336/186, 220, 222, 116–136, 205

See application file for complete search history.

(56) References Cited

U.S. PATENT DOCUMENTS

| | | | | |
|---|---|---|---|---|
| 3,201,728 | A * | 8/1965 | McWhirter | 336/60 |
| 3,631,367 | A * | 12/1971 | Dutton et al. | 336/70 |
| 4,761,628 | A * | 8/1988 | Nishi et al. | 336/180 |
| 5,619,176 | A * | 4/1997 | Hays | 336/150 |
| 7,852,650 | B2 * | 12/2010 | Taylor et al. | 363/100 |
| 2009/0284338 | A1 * | 11/2009 | Maruyama et al. | 336/182 |

FOREIGN PATENT DOCUMENTS

| | | |
|---|---|---|
| JP | 07-220955 | 8/1995 |
| JP | 09-186028 | 7/1997 |
| JP | 2005-158857 | 6/2005 |
| JP | 2006-128179 | 5/2006 |
| JP | 2010-028150 | 2/2010 |

* cited by examiner

*Primary Examiner* — Mohamad Musleh
*Assistant Examiner* — Mangtin Lian
(74) *Attorney, Agent, or Firm* — McDermott Will & Emery LLP

(57) ABSTRACT

There are many varieties of windings. Coils adopting an edgewise winding wire in which winding wires are wound around in the radial direction of the coil have a wide flux linkage area orthogonal to the electric wire, so that stray loss within the wire is increased, winding wire loss is increased and temperature is raised thereby. The present invention provides an arrangement in which a plurality of coil units are prepared and connected via external coupling terminals. At this time, winding is performed so that the contact faces of the coil units have equal potentials, so that there is no need to ensure an insulation distance between coils, and the coils can be downsized. Therefore, the mass of the respective coils can be reduced. Taps disposed on the respective coils are arranged to have equal potentials, according to which the external coupling terminals can double as tap switch terminals, so that there is no need to provide a dedicated tap switch.

2 Claims, 4 Drawing Sheets

COIL TRANSFORMER COMPOSED OF UNIT CONFIGURATION

The present application is based on and claims priority of Japanese patent application No. 2010-072455 filed on Mar. 26, 2010, the entire contents of which are hereby incorporated by reference.

BACKGROUND OF THE INVENTION

1. Field of the Invention

The present invention relates to a coil transformer composed of a unit configuration. More specifically, the present invention provides a plurality of (n number of) coil units, wherein external coupling terminals of the coil units are mutually connected to configure a transformer having a desired capacity.

2. Description of the Related Art

Conventionally, companies were able to perform energy administration per factory or per business office. However, due to the revision of the Rationalization in Japanese Energy Use Law, companies using a total energy of 1500 kl or higher in a year as a whole entity are now required to report to the government the amount of used energy and be designated as specified entities. In addition, by the enforcement of the transformer characteristics improvement act (adopting of top runner transformers) in 2006, it is now necessary to reduce the loss generated from the coils (hereinafter referred to as load loss).

The load loss in coils is broadly classified into a resistance loss generated by current flowing through the resistance of the winding wires and an eddy current loss (stray loss) generated by the leak magnetic flux from the iron core being interlinked with the winding wires. There are many types of winding wires, but the most dominant type in realizing a large-capacity device is an edgewise winding wire which is strong against electromagnetic mechanical force during short-circuit. However, since the edgewise winding wire has a large area interlinked with the magnetic flux, stray loss is increased. Therefore, along with the increase of load loss and rising of winding wire temperature, the cross-sectional area of the wire must be increased, according to which the transformer size is increased and the material costs are increased by the escalating material prices.

As described, edgewise winding wire transformers have been known. Patent document 1 (Japanese patent application laid-open publication No. 2005-158857) discloses a resin mold coil comprising a coil formed by winding a conductor and an insulation layer which is formed on the inner and outer peripheries of the coil, wherein the coil is formed by stacking, in the axial direction, a coil having an element wire wound several times from the outer to the inner periphery in the radial direction and a coil having the element wire wound several times from the inner to the outer periphery, for example, the direction 3 as shown in FIG. 1, and wherein the circumference of the coil is coated with the resin to obtain insulation. Thus, a mold coil having superior heat dissipation property, insulation property and workability during manufacturing is provided, which is down-sized and strong against electromagnetic mechanical force during short-circuit.

Furthermore, patent document 2 (Japanese patent application laid-open publication No. 9-186028) discloses a transformer provided with a switch for switching the connection of two windings in series or in parallel, wherein a high-voltage winding which is a series-parallel changeover winding in which the winding ratio is approximately 2:1 is provided as a primary winding or a secondary winding, and wherein a tapped winding is arranged outside the high-voltage winding. According to the disclosed art, the outer diameter dimension of the whole body of the winding can be downsized since there is no need to provide a space for forming an opening for drawing out the tap winding.

Moreover, patent document 3 (Japanese patent application laid-open publication No. 7-220955) discloses a non-voltage tap switching device wherein switching between parallel and series connection of a transformer winding divided into three parts can be readily performed inside a transformer. According to the disclosed art, movable contacts are rotated by operating a driving shaft which is drawn out of a transformer tank, and the connection between fixed contacts is switched, so as to switch the transformer windings divided into three between series and parallel connection.

SUMMARY OF THE INVENTION

The present invention aims at solving the problems of the prior art by providing a transformer having a desired capacity by preparing a plurality of (n) coil units and mutually connecting external coupling terminals of the respective coil units. At this time, winding is performed so that the contact faces of the respective coil units are of equal potential, according to which the coil can be downsized since there is no need to ensure an insulation distance between the coil units.

There are many types of wiring methods. One of such methods is an edgewise winding wire system in which the winding wires are wound around in the radial direction of the coil, and as shown in FIG. 1, since the interlinked area of the electric wires 2 and the magnetic flux 1 in the orthogonal direction is wide, according to which the stray loss within the winding 2 is increased, leading to the increase of winding loss and the rising of temperature accompanying the same. However, since the edgewise winding wire has a large radial area, it is strong against electromagnetic mechanical force in the radial direction generated during short circuit, and thus, it can be effectively applied to large-capacity models. However, as the capacity of the transformer increases, the amount of used wire increases and thus the stray loss increases. Further, since the mass per single winding wire is increased, when an edgewise winding wire not having any supplementary insulation member between layers is adopted in a transformer with only a single winding wire, the possibility of insulation breakdown is high, by which the coating of the electric wire may be damaged. Therefore, it is necessary to rid the potentials of increase of stray loss and damage of wire coating.

In order to cut down stray loss, it is necessary to downsize the electric wire so as to minimize the cross-sectional area interlinked with magnetic flux. The adopting of a cylindrical winding wire in which the electric wire can be minimized or the changing of electric wire dimension of the edgewise winding wire is considered. The cylindrical winding wire has a small radial direction wire dimension, so it is weak against electromagnetic mechanical force in the radial direction during short circuit. The electromagnetic mechanical force increases along with the increase of capacity, so that it is difficult to adopt cylindrical winding wires. When the wire dimension of the edgewise winding wire is changed, the cross-sectional area of the electric wire is increased, according to which the transformer is increased in size and the manufacturing costs are increased.

Therefore, the present invention aims at providing a transformer having a large capacity, capable of adopting an edgewise winding wire without increasing the electric wire dimension.

The present invention provides a coil transformer composed of a unit configuration in which a plurality of coil units each having an edgewise winding wire having n number of windings are prepared, wherein each coil unit has a winding start terminal disposed near one of the end faces (winding start-side end face) and a winding end terminal disposed near the other end face (winding end-side end face), and at least one tap draw-out terminal having a somewhat smaller number of windings than the number of windings (n windings), the end faces being arranged to oppose to one another so that contact faces of the respective coil units have equal potentials, wherein selected winding end terminals are connected in this opposed state, and one of the winding start terminal near the end face positioned on the uppermost side or the winding start terminal near the end face positioned on the lowermost side is set as the winding start terminal and the other one is set as the winding end terminal, so that a transformer having a maximum of 2n windings is configured.

Further, the present invention provides a coil transformer composed of a unit configuration in which a plurality of coil units each having an edgewise winding wire having n number of windings are prepared, wherein each coil unit has a winding start terminal disposed near one of the end faces (winding start-side end face) and a winding end terminal disposed near the other end face (winding end-side end face), and at least one tap draw-out terminal having a somewhat smaller number of windings than the number of windings (n windings), the end faces being arranged to oppose to one another so that contact faces of the respective coil units have equal potentials, wherein selected terminals out of the terminals arranged near end faces positioned close to each other in the opposed arrangement are connected, with one of the winding start terminal near the end face positioned on the uppermost side or the winding start terminal near the end face positioned on the lowermost side set as the winding start terminal and the other one set as the winding end terminal, so that a transformer having a desired number of windings can be configured.

Moreover, the present invention provides a coil transformer composed of a unit configuration, wherein a plurality of coil units are created, and the coil units are arranged so that the contact faces of the respective coil units are of equal potential.

Even further, the present invention provides a coil transformer composed of a unit configuration, wherein a plurality of coil units are created, and a height adjustable rubber is disposed between the respective coil units so as to form a cooling space.

The present invention further provides a coil transformer composed of a unit configuration, wherein a plurality of coil units are created, and at least one tap draw-out terminal having a somewhat smaller number of windings than the number of windings (n windings) is disposed near the winding end terminal, so that a connection terminal for connecting the respective coil units can double as a tap switch terminal of the respective coil units used when varying the number of windings from the n windings.

The present invention provides a coil transformer capable of reducing stray loss and cutting down increase of temperature, according to which the transformer can be downsized since there is no need to ensure a large electric wire cross-sectional area. Further, since the coil mass can be reduced, it becomes possible to rid the potentials of insulation breakdown caused by the damaging of the electric wire coating.

More than n number of coils are prepared, and the coils are connected via external coupling terminals. At this time, since winding is performed so that the contact faces of the respective coils are of equal potential, it is no longer necessary to ensure an insulation distance between coils and thus the coils can be downsized.

Furthermore, by providing taps in the respective coils and arranging the taps to be of equal potential in the manner mentioned above, the external coupling terminals can double as tap switching terminals.

DETAILED DESCRIPTION OF THE PREFERRED EMBODIMENTS

[Embodiment 1]

Figure 1:
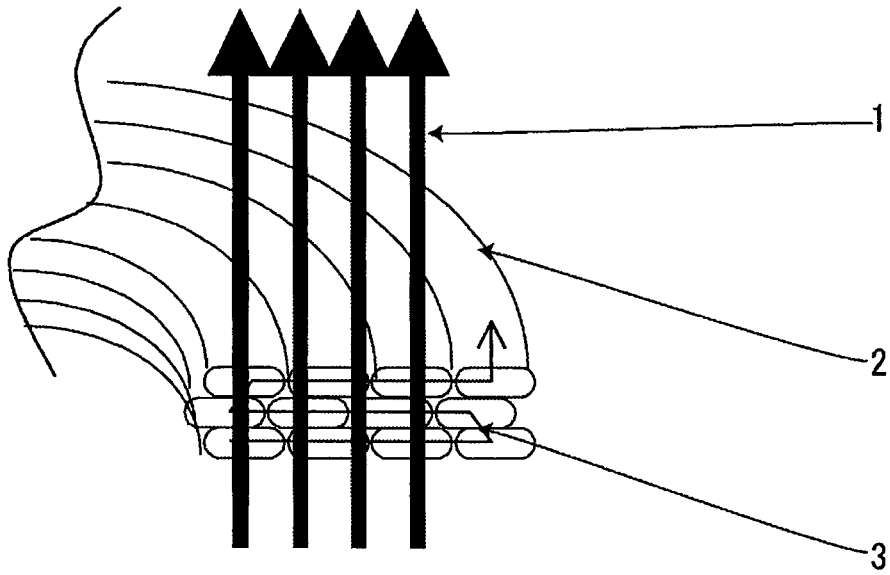
FIG. 1 is an explanatory view illustrating the principle of generation of stray loss.

Two mold coil units (5 and 6) having a total number of windings N divided into N/2 windings (=n windings) are formed. The structures of the two coil units 5 and 6 are the same. In other words, each coil has an edgewise winding wire, such as 7 and 8 in FIGS. 2 and 3 having n windings, and the coil unit is equipped with a winding start terminal 9 and a winding end terminal 11 (n windings).

Although the actual state of connection is not illustrated, an end face of the side of the winding end terminal 11 of the No. 1 coil unit 5 is opposed and attached to an end face of the side of the winding end terminal 11 of the No. 2 coil unit 6, wherein the winding end terminal 11 of the No. 1 coil unit 5 (n windings) and the winding end terminal 11 of the No. 2 coil unit 6 (n windings) are drawn out to an external connection section and connected via external coupling terminals. Thus, a series (continuous) connection is realized and the total number of windings will be a maximum of (2n=N) windings.

Since this connection is a series connection, the opposing ends of the No. 1 coil unit 5 and the No. 2 coil unit 6 will have equal potential, so that there is no need to ensure an insulation distance therebetween. However, by laying down height adjustable rubber 15, 16 between the coils for adjusting the height of the coils, it becomes possible to ensure a cooling path and to improve the cooling performance thereof. Thereby, the number of windings per a single coil can be reduced, so that the mass of the coil and the rising of temperature thereof can be reduced.

[Embodiment 2]

Two mold coil units (5 and 6) having a total number of windings N divided into N/2 windings (=n windings) are formed. The structures of the two coil units 5 and 6 are the same. In other words, each coil has n windings, and the coil unit is equipped with a winding start terminal 9 and a winding end terminal 11 (n windings). In the proximity of the winding end terminal 11 (n windings) are disposed tap draw-out terminals 12 (n−a windings) and 13 (n−b windings) having somewhat smaller numbers of windings. In the embodiment, for example, n equals 300, a equals 15 and b equals 30. As can be recognized from this embodiment, what is meant by "somewhat" according to the present invention is the difference in the number of windings equal to or smaller than approximately 10% of the n number of windings.

Figure 2:
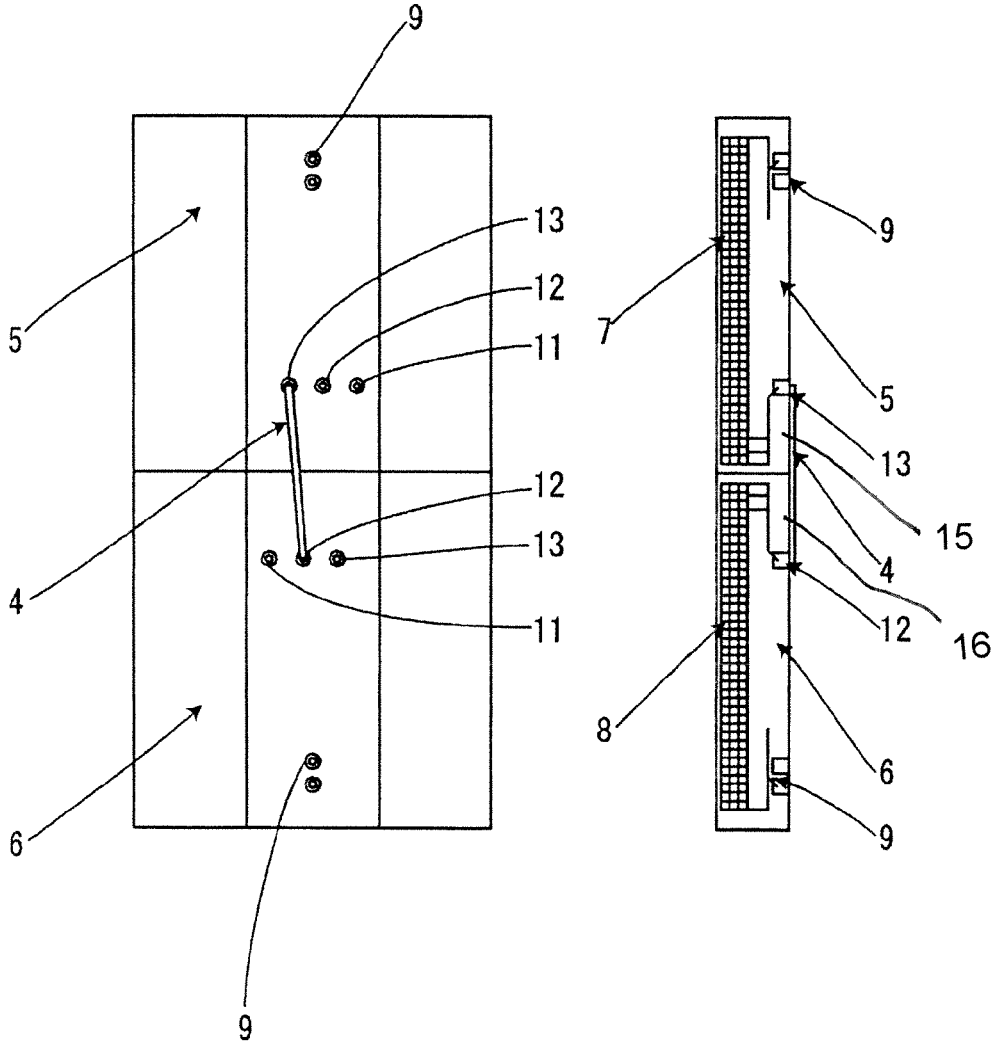
FIG. 2 is a view showing a coil transformer composed of a unit configuration according to the present invention, wherein coils are connected in series.
Figure 3:
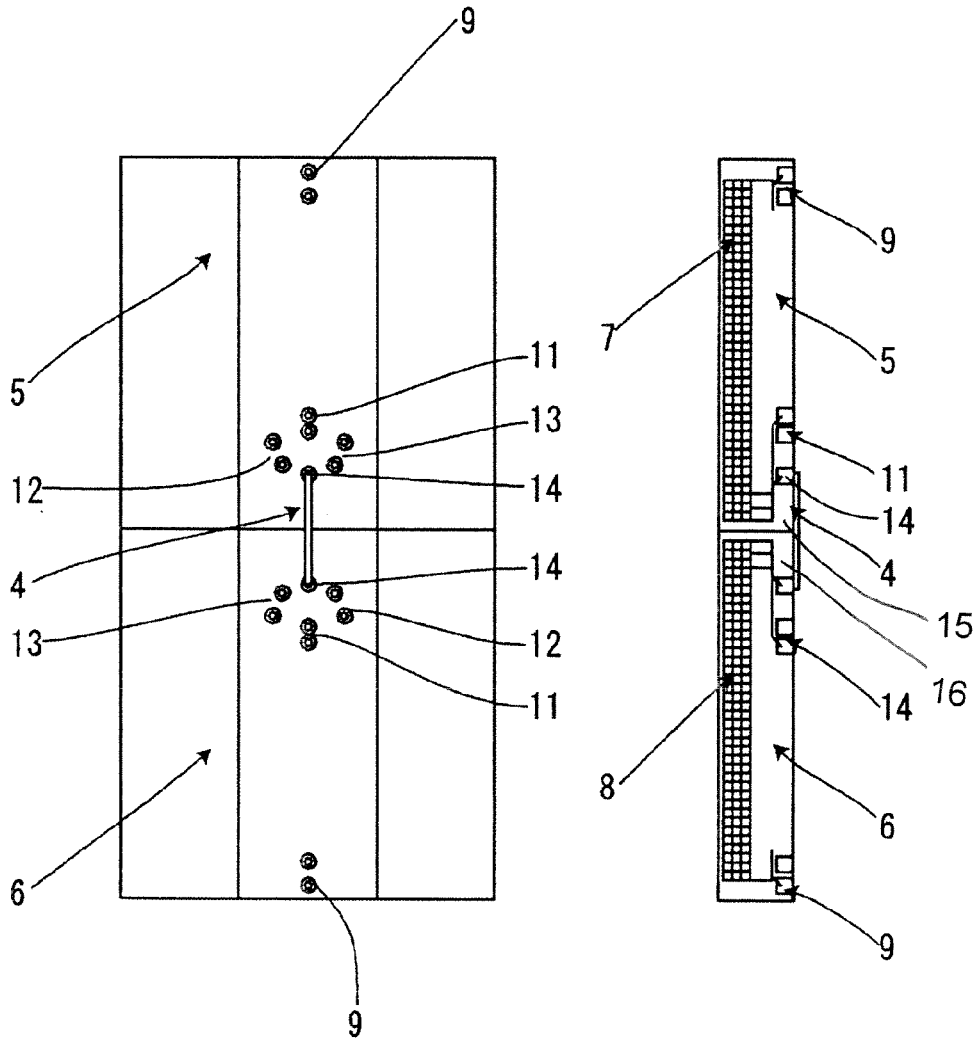
FIG. 3 is a view showing a coil transformer composed of a unit configuration according to the present invention, wherein coils are connected in parallel.

As shown in FIG. 2, an end face of the side having the winding end terminal 11 of the No. 1 coil unit 5 is opposed and attached to an end face of the side having the winding end terminal 11 of the No. 2 coil unit 6, wherein the tap draw-out terminal 13 of the No. 1 coil unit 5 (n−b windings) and the tap draw-out terminal 12 of the No. 2 coil unit 6 (n−a windings) are drawn out to an external connection section and connected via external coupling terminals. Thus, a series (continuous) connection is realized and the total number of windings will be (2n−a−b) windings. In other words, by selecting the terminals to be connected, it becomes possible to select the total number of windings from the range of 2n=N to 2n−2b. At this time, the terminal for series connection is designed to double as a tap switching terminal, so that there is no need to form an independent tap switch.

Since the present connection is a series connection, the areas where the No. 1 coil unit and the No. 2 coil unit contact each other are of equal potential, so that there is no need to ensure an insulation distance therebetween. However, by laying down height adjustable rubber 15, 16 between the coil units for adjusting the height of the coils, it becomes possible to ensure a cooling path and improve the cooling performance thereof. Thereby, the number of windings per a single coil can be reduced, so that the mass of the coil and the rising of temperature thereof can be reduced (refer to FIG. 2).

[Embodiment 3]

Two mold units 5 and 6 are manufactured in which the total number of windings are n times. Each of the No. 1 coil unit 5 and No. 2 coil unit 6 has a tap. At this time, the upper side of the No. 1 coil unit 5 is the winding start side and the lower side thereof is the winding end side, wherein tap draw-out terminals 12, 13 and 14 are disposed close thereto. The No. 2 coil unit 6 is placed up-side down wherein the upper portion thereof is the winding end side, and tap draw-out terminals 12, 13 and 14 are disposed close thereto. By connecting the tap draw-out terminal 14 of the No. 1 coil unit 5 and the tap draw-out terminal 14 of the No. 2 coil unit 6, the tap switch can double as a parallel connection terminal.

At this time, by connecting the tap draw-out terminal 14 of the No. 1 coil unit 5 and the tap draw-out terminal 14 of the No. 2 coil unit 6 and outputting an inter-terminal connection 4, a parallel connection is realized. The current value can be reduced to half according to this arrangement, by which the electric wire dimension within the coil can be reduced, and the stray loss can thereby be reduced. According further to the connection of the present embodiment, both the opposing faces of the No. 1 coil unit 5 and the No. 2 coil unit 6 are winding ends and thus have equal potentials, so that there is no need to ensure an insulation distance therebetween. However, by laying down height adjustable rubber 15, 16 between the coils for adjusting the height of the coils, it becomes possible to ensure a cooling path and improve the cooling performance thereof (refer to FIG. 3).

Figure 4:
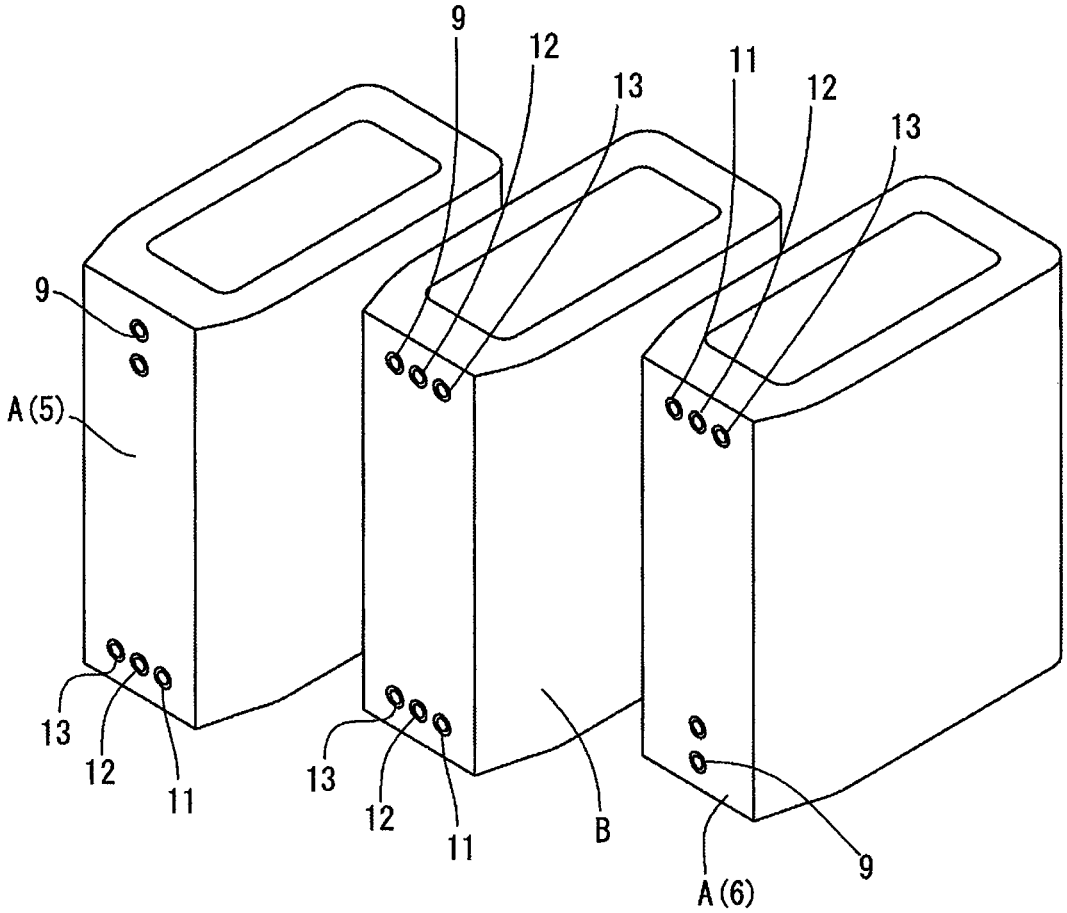
FIG. 4 is a perspective view of coil units constituting the coil transformer composed of a unit configuration according to the present invention.

FIG. 4 is a perspective view of a coil unit constituting a coil transformer composed of a unit configuration according to the present invention, wherein two kinds of coil units are shown. Coil unit A is the same as the above-mentioned No. 1 coil unit 5 or the No. 2 coil unit 6, having n windings and having a winding start terminal 9 and a winding end terminal 11 (n windings) as a coil unit. Tap draw-out terminals 12 (n−a windings) and 13 (n−b windings) are disposed close to the winding end terminal 11 (n windings). According to the present embodiment, for example, n equals 300, a equals 15 and b equals 30. The coil unit B is a No. 3 coil unit inserted between the No. 1 coil unit 5 and the No. 2 coil unit 6 when configuring a transformer using three coil units, and comprises a winding start terminal 9 and a winding end terminal 11 (n windings). Tap draw-out terminals 12 (n−a windings) and 13 (n−b windings) are disposed close to the winding start terminal 9, and tap draw-out terminals 12 (n−a windings) and 13 (n−b windings) are disposed close to the winding end terminal 11 (n windings).

As described, the present invention provides a plurality of coil units, wherein the respective terminals of the coil units are connected via external coupling terminals. According to this arrangement, by performing winding so that the connecting faces of the coil units have equal potentials, there is no need to ensure an insulation distance between coils (90 mm or greater), and the coil units can therefore be downsized. Thus, the mass of the respective coil units can be reduced. Each coil unit has a tap which is arranged as an equal potential portion, so that the external coupling terminal can also double as a tap switch terminal, and there is no longer any need to dispose an independent tap switch.

The external coupling terminal enables connection to be changed easily between a series connection and a parallel connection. By adopting parallel connection, the current value can be reduced to half, by which the electric wire dimension within the coil can be reduced, and the stray loss can thereby be reduced. Furthermore, by disposing a clearance between the coil contact area and forming a cooling path, the cooling performance of the coil can be improved.

The present invention creates a plurality of coil units, and the coil units are connected via external coupling terminals. At this time, by performing winding so that the contact faces of the respective coil units have equal potentials, there is no need to ensure an insulation distance between the coil units, and the coil units can be downsized. Since each coil unit has a tap which is arranged as an equal potential portion, the external coupling terminal can double as a tap switch terminal. The external coupling terminal enables the connection to be changed easily between a series connection and a parallel connection, and when parallel connection is adopted, the current value can be reduced to half, by which the electric wire dimension within the coil can be reduced and the stray loss can thereby be reduced. Furthermore, by disposing a clearance between the coil contact area and forming a cooling path, the cooling performance of the coil can be improved.

The present invention provides an external coupling terminal capable of changing the connection method easily, and when parallel connection is adopted, the current value can be reduced to half, by which the electric wire dimension within the coil can be reduced and the stray loss can thereby be reduced. By disposing a clearance between the coil contact area, the cooling performance of the coil can be improved.

The present invention provide a coil transformer composed of a unit configuration in which a plurality of coil units are provided, wherein by connecting the respective coil units, the winding method can easily be changed between series connection and parallel connection.

The present invention provides a coil transformer composed of a unit configuration in which a plurality of coil units are provided, wherein the connecting terminals of the respective coil units can double as a tap switch capable of varying the number of windings.

The present invention provides a coil transformer composed of a unit configuration in which a plurality of coil units are provided, wherein the respective coil units are wound and arranged so that the contact faces of the coil units have equal potentials, so that the heights of the coils can be reduced.

The present invention also provides a coil transformer composed of a unit configuration in which a plurality of coil units are provided, wherein a height adjustable rubber is arranged between the respective coil units to form a cooling space.

What is claimed is:

1. A coil transformer composed of a unit configuration in which a plurality of coil units each having an edgewise winding wire having n number of windings are prepared, wherein:

each coil unit, being removably attachable from each other, has a winding start terminal disposed near one of the end faces (winding start-side end face) and a winding end terminal disposed near the other end face (winding end-side end face), and at least one tap draw-out terminal having a smaller number of windings than n windings, the end faces being arranged to oppose one another so that contact faces of the respective coil units have equal potentials, wherein selected terminals out of the tap draw-out terminals positioned close to each other in the opposed arrangement are connected, with one winding start terminal near the end face positioned on the uppermost side or the winding start terminal near the end face positioned on the lowermost side set as the winding start terminal and the other one set as the winding end terminal, so that a transformer having a desired number of windings can be configured, wherein the tap draw-out terminals are configured as tap switch terminals and connection terminals configured to connect the respective coil units, and a selected tap switch terminal of one of the coil units is configured to connect to another selected tap switch terminal of the another coil unit with an inter-terminal connection, such that by changing the selected terminals that are connected with each other, the number of windings may vary from the n windings.

2. The coil transformer composed of a unit configuration according to claim 1, wherein a plurality of coil units are created, and a height adjustable rubber is disposed between the respective coil units so as to form a cooling space.

* * * * *